US011473738B1

(12) United States Patent
Huang et al.

(10) Patent No.: US 11,473,738 B1
(45) Date of Patent: Oct. 18, 2022

(54) LIGHTING DEVICE

(71) Applicant: ELEMENTS PERFORMANCE TECHNOLOGY INC., Kaohsiung (TW)

(72) Inventors: Kuo-Sung Huang, Kaohsiung (TW); Jerryson Lee, Kaohsiung (TW); Ethan Lee, Kaohsiung (TW); Yu-Jia Huang, Kaohsiung (TW)

(73) Assignee: ELEMENTS PERFORMANCE TECHNOLOGY INC., Kaohsiung (TW)

( * ) Notice: Subject to any disclaimer, the term of this patent is extended or adjusted under 35 U.S.C. 154(b) by 0 days.

(21) Appl. No.: 17/676,207

(22) Filed: Feb. 20, 2022

(30) Foreign Application Priority Data

Oct. 20, 2021 (TW) ..... 110138794

(51) Int. Cl.

| | |
|---|---|
| ***F21S 2/00*** | (2016.01) |
| ***F21S 4/28*** | (2016.01) |
| ***F21V 23/00*** | (2015.01) |
| ***F21V 23/04*** | (2006.01) |
| ***F21V 21/14*** | (2006.01) |
| ***F21V 21/40*** | (2006.01) |
| ***F21Y 103/10*** | (2016.01) |

(52) U.S. Cl.
CPC ..... *F21S 2/005* (2013.01); *F21S 4/28* (2016.01); *F21V 21/14* (2013.01); *F21V 21/40* (2013.01); *F21V 23/001* (2013.01); *F21V 23/0442* (2013.01); *F21V 23/0471* (2013.01); *F21Y 2103/10* (2016.08)

(58) Field of Classification Search
CPC ..... F21S 2/005; F21S 8/085; F21V 23/001; F21V 23/007; F21V 23/008
See application file for complete search history.

(56) References Cited

U.S. PATENT DOCUMENTS

| | | | | |
|---|---|---|---|---|
| 8,087,807 | B2 * | 1/2012 | Liu | F21V 29/75 362/373 |
| 8,157,420 | B2 * | 4/2012 | Song | F21V 21/30 362/373 |
| 9,869,435 | B2 * | 1/2018 | DeCarr | F21V 15/01 |

(Continued)

FOREIGN PATENT DOCUMENTS

| | | |
|---|---|---|
| CN | 201448657 U | 5/2010 |
| CN | 104421811 A | 3/2015 |

(Continued)

*Primary Examiner* — William N Harris
(74) *Attorney, Agent, or Firm* — Li & Cai Intellectual Property Office

(57) ABSTRACT

A lighting device includes a plurality of main bodies, a first casing, a plurality of second casings, a control module, and a plurality of light-emitting modules. One side of each of the plurality of main bodies has the light-emitting modules arranged thereon, and the light-emitting module is electrically connected to the control module. One second casing is fixedly disposed on another side of each of the plurality of main bodies that is opposite to the one side where the light-emitting module is disposed, and a passage is formed between the second casing and the main body. The control module with a plug-in design is disposed in the first casing, so that the control module is arranged away from the plurality of light-emitting modules.

8 Claims, 9 Drawing Sheets

(56) References Cited

U.S. PATENT DOCUMENTS

| | | | | |
|---|---|---|---|---|
| 10,527,238 | B1 | 1/2020 | Huang et al. | |
| 2010/0118534 | A1* | 5/2010 | Lo | F21V 29/763 362/249.02 |
| 2011/0002120 | A1* | 1/2011 | Song | F21V 29/89 362/249.02 |
| 2011/0013392 | A1* | 1/2011 | Little, Jr. | F21V 15/013 362/373 |
| 2011/0032696 | A1* | 2/2011 | Kim | F21S 2/005 362/184 |
| 2012/0106152 | A1* | 5/2012 | Zheng | F21V 23/008 362/249.02 |
| 2013/0003378 | A1* | 1/2013 | Dube | F21V 29/763 362/249.03 |
| 2013/0027935 | A1* | 1/2013 | Ladewig | F21V 29/508 29/592.1 |
| 2015/0354794 | A1* | 12/2015 | Guercio | F21V 29/745 362/249.1 |
| 2017/0370537 | A1* | 12/2017 | Wu | F21V 17/02 |
| 2022/0057054 | A1* | 2/2022 | Zheng | F21V 23/003 |

FOREIGN PATENT DOCUMENTS

| | | | |
|---|---|---|---|
| TW | M594106 | U | 4/2020 |
| TW | 202043668 | A | 12/2020 |
| WO | WO2008024243 | A2 | 2/2008 |

* cited by examiner

LIGHTING DEVICE

CROSS-REFERENCE TO RELATED PATENT APPLICATION

This application claims the benefit of priority to Taiwan Patent Application No. 110138794, filed on Oct. 20, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a lighting device, and more particularly to a high-wattage lighting device.

BACKGROUND OF THE DISCLOSURE

Conventional lighting devices have a joint fixing member that is adjustable to fit a predetermined number of light-emitting modules, so as to meet consumer demands for brightness. High-wattage light-emitting modules not only generate a lot of heat, but are also often used in places that necessitate bright light, specifically in places such as sewers, construction sites, offshore operations, fishing boats, etc. However, the humidity in such places causes the light-emitting modules to be exposed to high temperature and high humidity, which results in decreased service life and deteriorated performance of a control module of the lighting device.

Therefore, how to improve a structural design, so as to increase overall life and performance of the control module of the lighting device to overcome the above-mentioned problems, has become one of the important issues to be addressed in the related art.

SUMMARY OF THE DISCLOSURE

In response to the above-referenced technical inadequacies, the present disclosure provides a lighting device.

In one aspect, the present disclosure provides a lighting device, which includes a plurality of main bodies, a first casing, two first covers, at least one supporting structure, a control module, and a plurality of light-emitting modules. Each of the plurality of main bodies is strip-shaped, and the plurality of main bodies are aligned with each other and collectively defined as a main body assembly. The first casing has a first top wall, two first side walls, and two first fixing walls. Two side edges of the first top wall that are opposite to each other are respectively connected to the two first side walls, the two first side walls are arranged opposite to each other, one side edge of each of the two first side walls that is opposite to another side edge of each of the two first side walls connected to the first top wall extends in a direction away from the side wall and is connected to one of the two first fixing walls, and the first casing defines a first accommodation space. The two first covers are fixedly disposed on two sides of the first casing, respectively. The at least one supporting structure is disposed on the main body assembly so as to support the first casing. The at least one supporting structure has a pivot structure. The control module is fixedly disposed in the first casing, and the control module is disposed in the first accommodation space. At least one of the plurality of light-emitting modules is fixedly disposed on a bottom side of each of the plurality of main bodies and each of the plurality of light-emitting modules includes a circuit board, a plurality of light-emitting units, and a light transmitting assembly. The circuit board is fixedly disposed on the bottom side of the main body, the plurality of light-emitting units are disposed on a side of the circuit board that is away from the bottom side of the main body, the light transmitting assembly is fixed disposed on the side of the circuit board that is away from the bottom side of the main body, and the light transmitting assembly correspondingly covers the plurality of light-emitting units. Each of the plurality of light-emitting modules includes at least one electrical connection line, the at least one electrical connection line is electrically connected to the control module, and the control module is configured to control each of the plurality of light-emitting modules.

Therefore, one of the beneficial effects of the present disclosure is that, in the lighting device provided by the present disclosure, the control module accommodated in the first casing is separated from the lighting-emitting modules arranged on the bottom sides of the main bodies by the at least one supporting structure, so that heat generated by the light-emitting modules with high wattage can avoid affecting a life and performance of the control module by heat transferring and thermal convection. Therefore, the service life and performance of the lighting device with high wattage can be effectively increased in specific environments.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
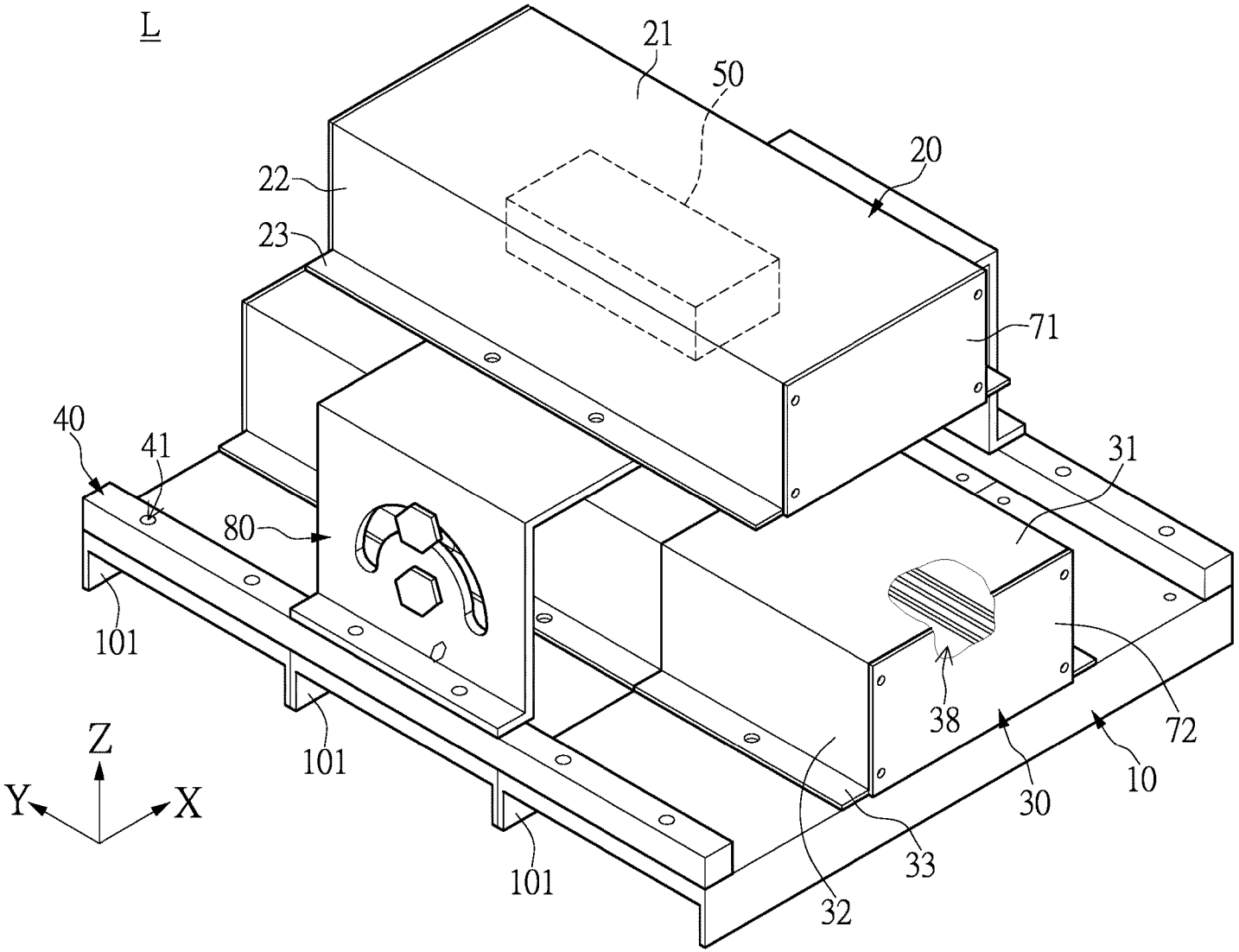
FIG. 1 is a schematic assembled view of a lighting device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
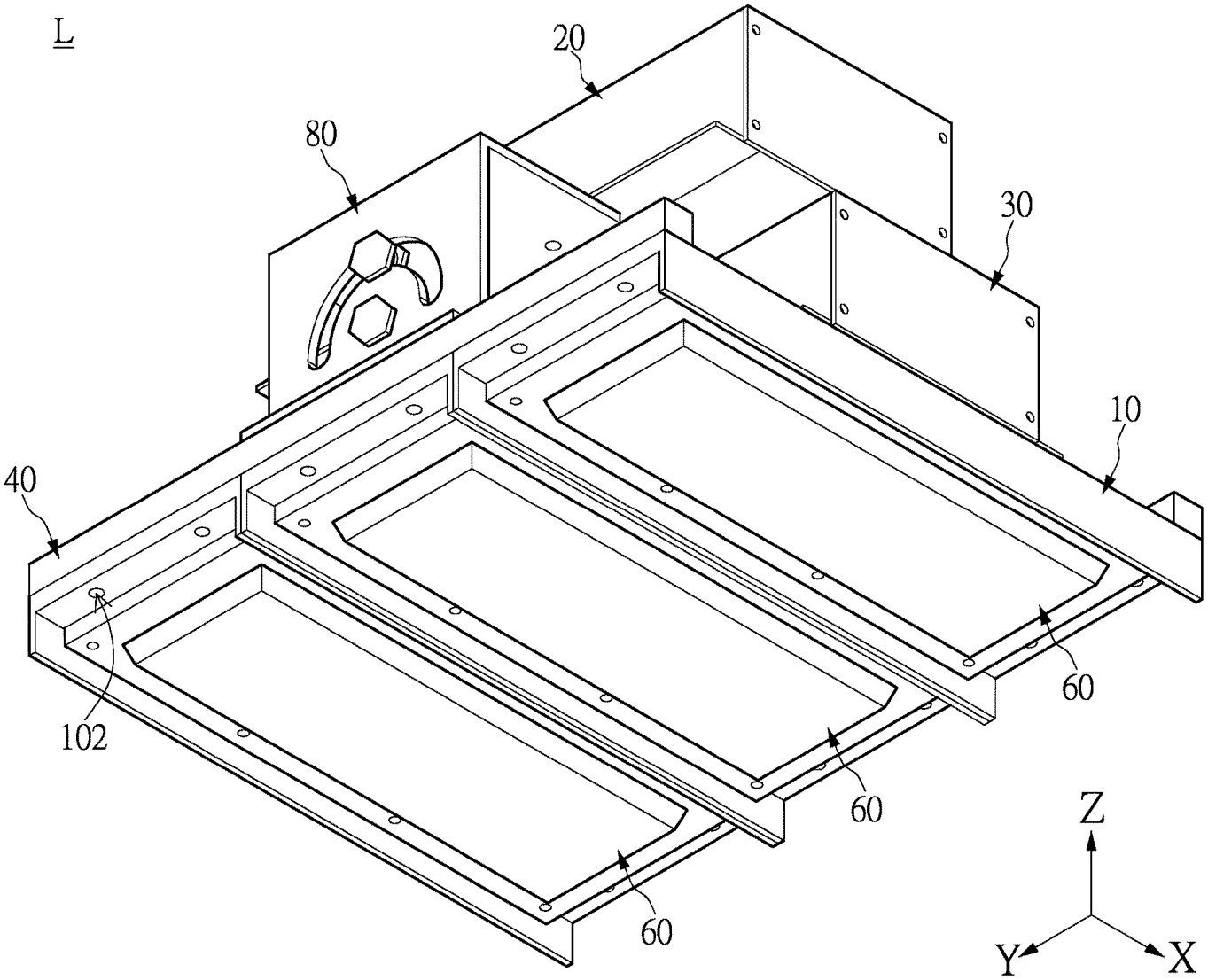
FIG. 2 is a schematic assembled view of the lighting device from another angle of view according to the first embodiment of the present disclosure.
Figure 3:
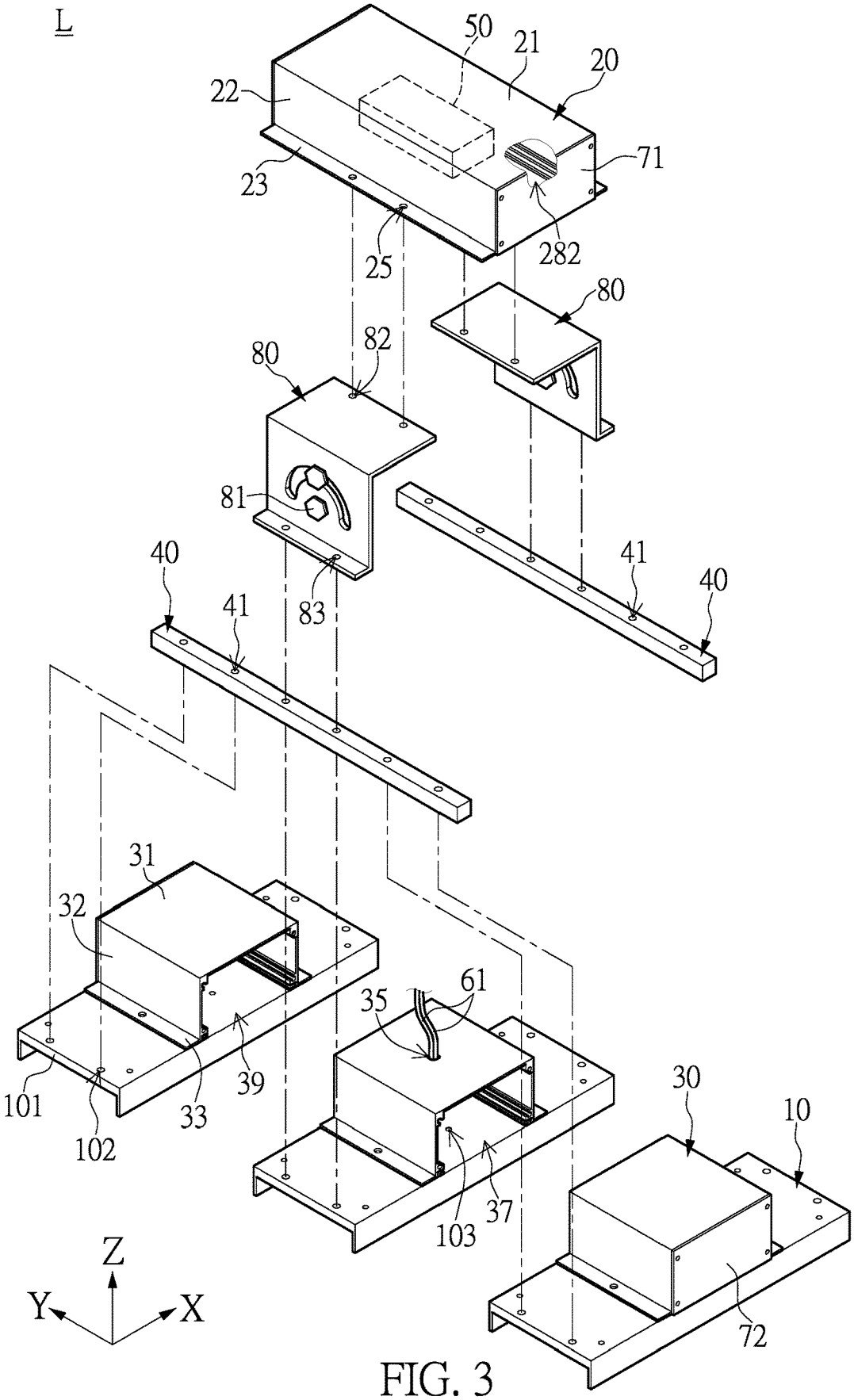
FIG. 3 is a schematic exploded view of the lighting device according to the first embodiment of the present disclosure.

Referring to FIG. 1 to FIG. 4, a lighting device L of the present disclosure provides a plurality of main bodies 10, a first casing 20, a plurality of second casings 30, two joint fixing members 40, a control module 50, a plurality of light-emitting modules 60, two first covers 71, two second covers 72, and at least one supporting structure 80. For example, a number of the plurality of main bodies 10 is three, and the three main bodies 10 are aligned with each other as shown in FIG. 3. The two joint fixing members 40 are fixedly disposed on two sides of each of the three fixing members 40, respectively. A number of the plurality of second casings 30 is three, and the three second casings 30 are aligned with each other and respectively disposed on the three main bodies 10. One end of the supporting structure 80 is fixed in one of the two joint fixing members 40, and another end of the supporting structure 80 is connected to the first casing 20, so that the first casing 20 is external to the three second casings 30, and a distance between a top side of each of the three second casings 30 and a bottom side of the first casing 20 is at least 4 cm. The control module 50 is fixedly disposed in the first casing 20. A number of the plurality of light-emitting modules 60 is three, and the three light-emitting modules 60 are respectively disposed on a side of the three main bodies 10. The two covers 71 are respectively disposed on two sides of two of the second casings 30, the two second casings 30 being respectively arranged at two ends of the lighting device L. It should be noted that, in the present embodiment, three main bodies 10, three second casings 30, and two light-emitting modules 60 disposed in each of the three main bodies 10 are exemplarily shown in the figures, but the number of the main bodies 10, the number of the second casings 30, and the number of the light-emitting modules 60 are not limited herein. The number of the main bodies 10, the number of the second casings 30, and the number of the light-emitting modules 60 can be adjusted according to a user demand for brightness. Multiple ones of the second casings 30 are aligned with each other and collectively defined as a second casing assembly, and multiple ones of the main bodies 10 are aligned with each other and collectively defined as a main body assembly.

Figure 5:
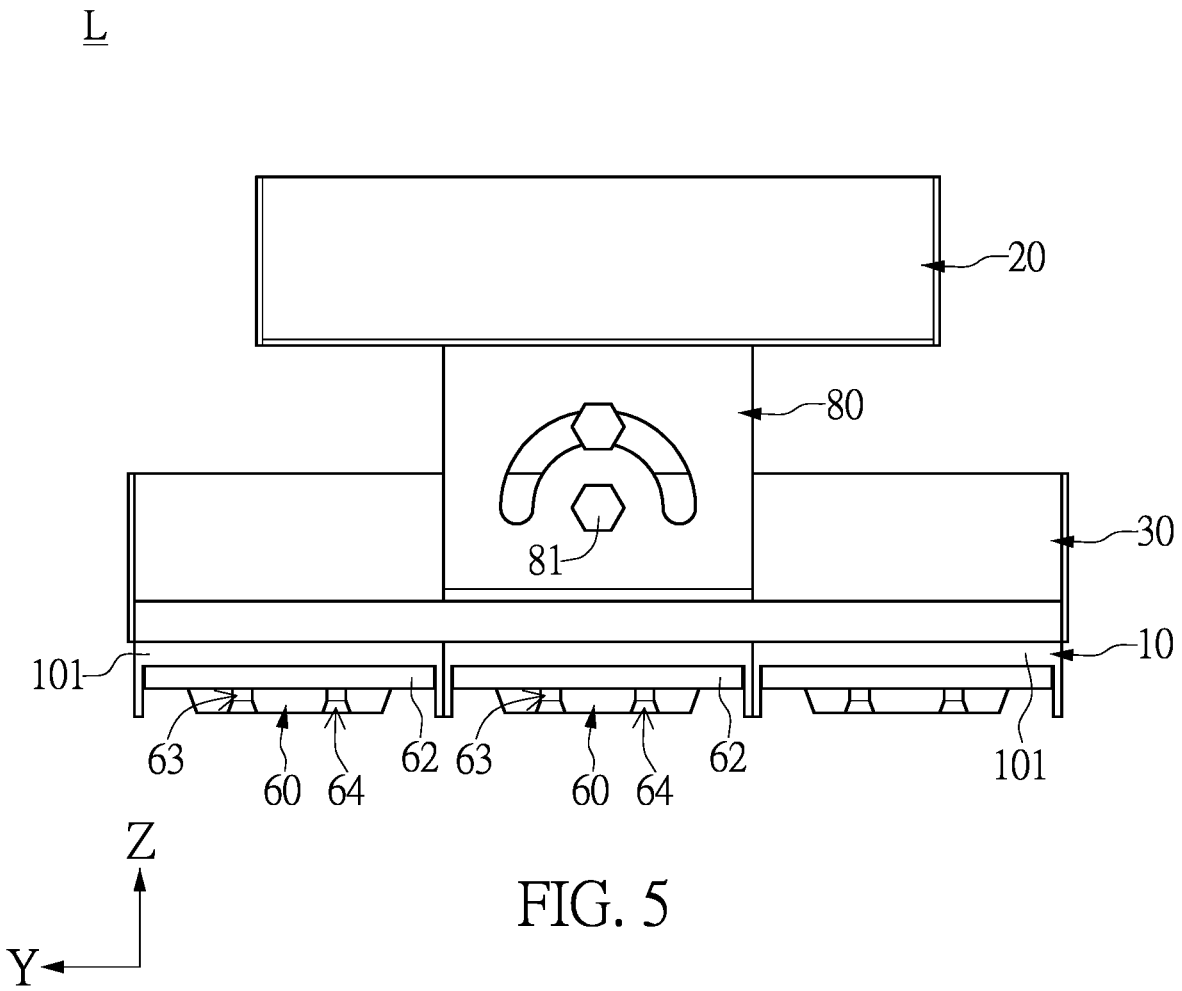
FIG. 5 is a schematic side view of the lighting device according to the first embodiment of the present disclosure.

Further, as shown in FIG. 5, each of the plurality of main bodies 10 is strip-shaped, and a bottom side of each of the plurality of main bodies 10 is recessed to form a recess 101. The recess 101 can be used for accommodating the light-emitting module 60. As shown in FIG. 3, each of the plurality of main bodies 10 has at least one first through hole 103 and a plurality of locking holes 102. The at least one first through hole 103 passes through the main body 10, and the recess 101 is communicated with an outside through the at least one first through hole 103. In this way, at least one electrical connection line 61 of the light-emitting module 60 that is disposed in the recess 101 can be electrically connected to the control module 50 by passing from the recess 101 through the first through hole 103 to be exposed from one side of the light-emitting module 60 that is opposite to another side of the light-emitting module 60 where the recess 101 is formed. A number of the first through holes 103 and a position of the first through hole 13 can be adjusted according to practical requirements, but is not limited to those shown in the figures. The number of the first through holes 103 in the first embodiment of the present disclosure is one.

The recess 101 of the main body 10 can have a plurality of locking holes (not shown in the figures) for the light-emitting module 60, and the light-emitting module 60 can be fixedly disposed on the main body 10 through a plurality of screwing members (e.g., screws; not shown in the figures). Therefore, the light-emitting module 60 can be correspondingly arranged in the recess 101. In another application, the main body 10 can not only be made of a metal material with high thermal conductivity, but can also have a fin structure in a part of the main body 10 (not shown in the figures), so as to increase an overall heat dissipation rate of the lighting device L.

Figure 4:
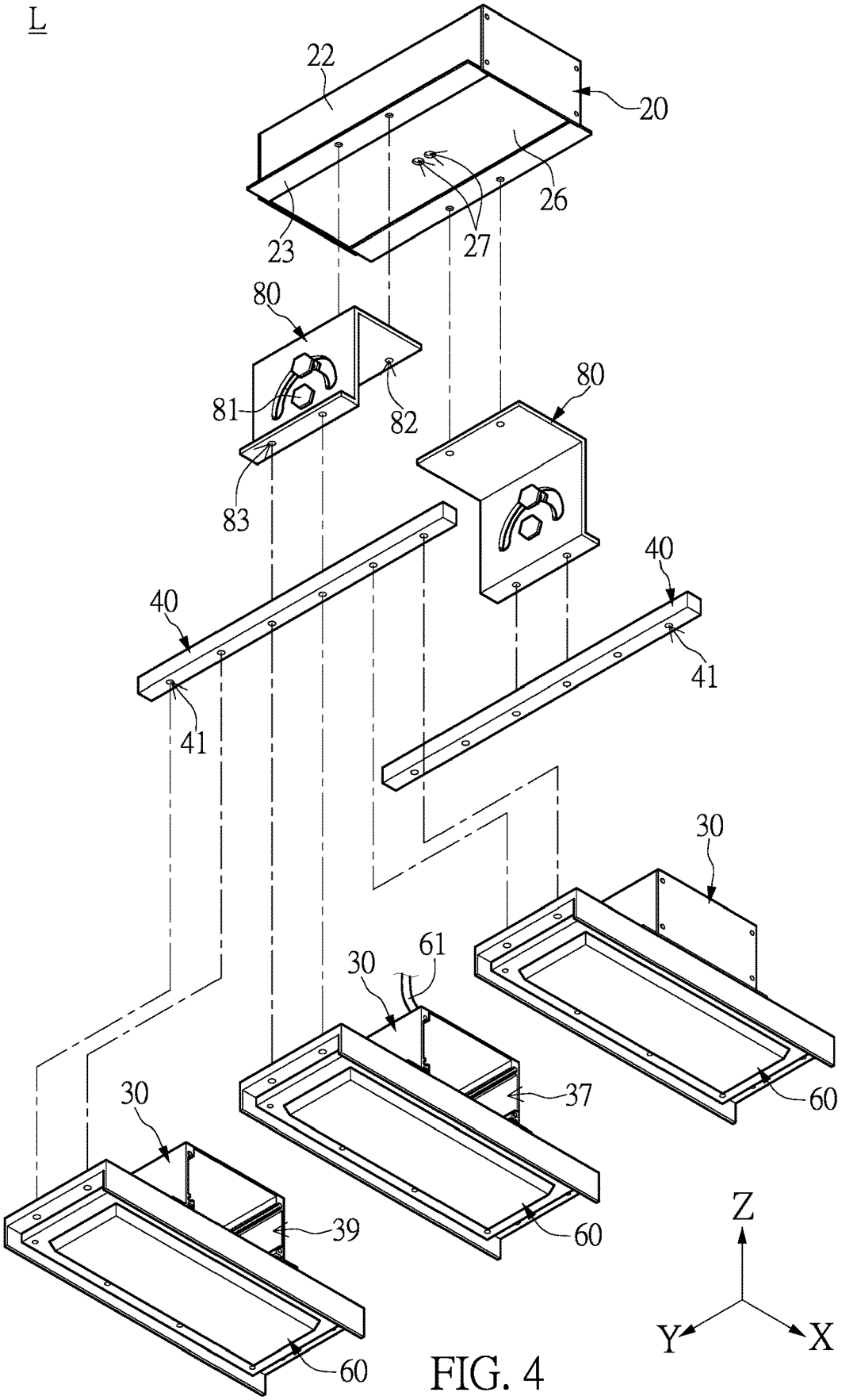
FIG. 4 is a schematic exploded view of the lighting device from another angle of view according to the first embodiment of the present disclosure.
Figure 6:
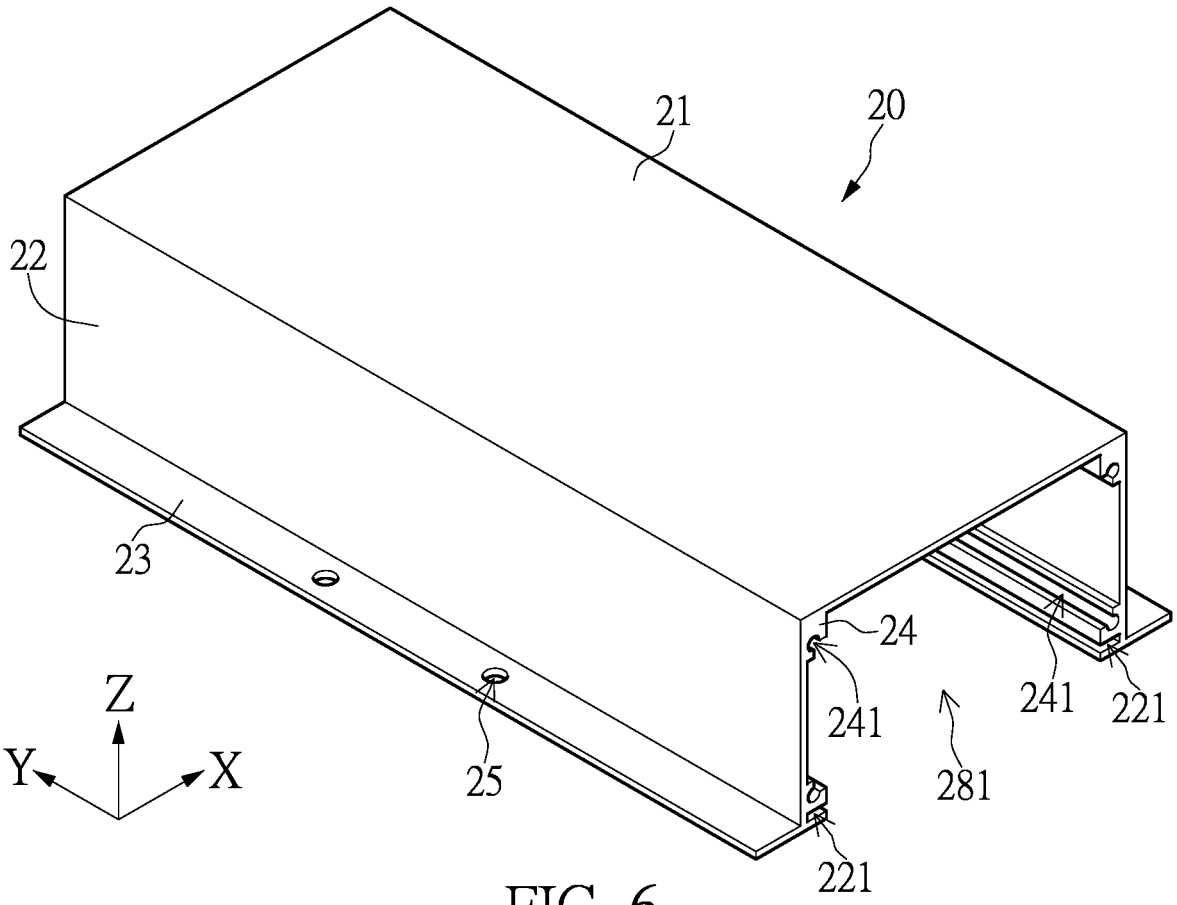
FIG. 6 is a partial enlarged view of a first casing of the lighting device according to the first embodiment of the present disclosure.

Referring to FIG. 3 and FIG. 4, the first casing 20 is roughly strip-shaped. The first casing 20 has a first top wall 21, two first side walls 22, two fixing walls 23, and a bottom plate 26. As shown in FIG. 6, the first top wall 21, the two first side walls 22, and the two first fixing walls 23 can be integrally formed to define a first accommodation space 281 formed thereamong, and the first accommodation space 281 can be used for accommodating the control module 50. Two side edges of the first top wall 21 that are opposite to each other correspondingly extend in a first direction (i.e., in a direction of a Z-axis) to respectively form the two first side walls 22, and the two first side walls 22 are arranged opposite to each other. That is, an arrangement of the first top wall 21 and the two first side walls is roughly in an inverted U shape. The bottom plate 26 is correspondingly connected to the two first side walls 22. One side edge of each of the two first side walls 22 that is opposite to another side edge of each of the two first side walls 22 connected to the first top wall 21 extends in a second direction (i.e., in a direction of an X-axis) to form the first fixing wall 23. That is, an arrangement of each of two first side walls 22 of each of the plurality of first casings 20 and the first fixing wall 23 connected thereto is roughly in an L shape. The second direction is not parallel to the first direction, and the second direction can be perpendicular to the first direction, but is not limited thereto.

As shown in FIG. 6, each of the two first side walls 22 has a sliding groove 221, and the bottom plate 26 can be inserted in the sliding grooves 221, so that the bottom plate 26 is correspondingly connected to the two first side walls 22.

Each of the two first fixing walls 23 of the first casing 20 is fixedly disposed at one end of the supporting structure 80. The bottom plate 26 has at least two second through holes 27. In the present embodiment and as shown in the figures, a number of the second through holes is exemplified as two. The electrical connection line 61 can be electrically connected to the control module 50 arranged in the first casing 20 by passing through the first through hole 103, a third through hole 35, and the two second through holes 27.

The first fixing wall 23 can be fixed on a top side of the supporting structure 80 by, for example, screwing, adhesive, soldering, etc., but is not limited thereto. The first fixing wall 23 in the first embodiment of the present disclosure has two second locking holes 25, and the two locking holes 25 respectively correspond to two fourth locking holes 82 of the supporting structure 80, and the first casing 20 can be fixedly disposed on the supporting structure 80 through a cooperation of the second locking hole 25, the fourth locking hole 82, and the plurality of lock members (e.g., the screws; not shown in the figures). The first casing 20 is configured to prevent thermal energy generated by the light-emitting module 60 from damaging the control module 50 by thermal radiation and thermal convection.

Figure 7:
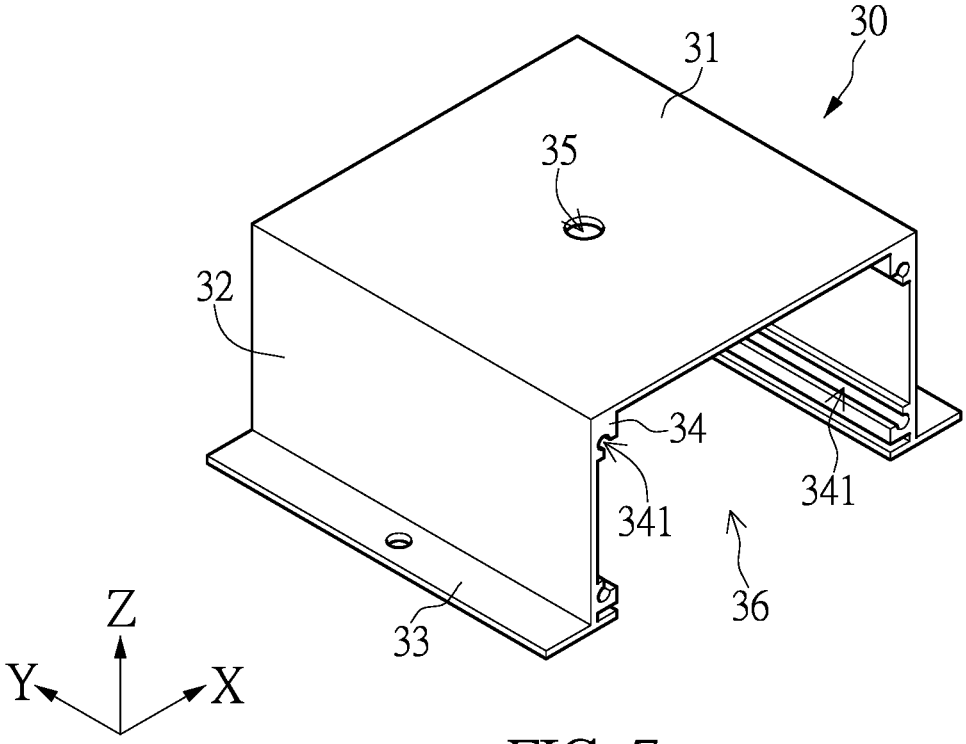
FIG. 7 is a partial enlarged view of a second casing of the lighting device according to the first embodiment of the present disclosure.

Referring to FIG. 1 and FIG. 2, each of the plurality of second casings 30 is roughly strip-shaped. As shown in FIG. 1, each of the second casings 30 has a second top wall 31, two second side walls 32, and two second fixing walls 33. As shown in FIG. 7, the second top wall 31, the two second side walls 32, and the two second fixing walls 23 can be integrally formed to have a second accommodation space 36 formed thereamong. Two side edges of the second top wall 31 that are opposite to each other correspondingly extend in the first direction (i.e., in the direction of the Z-axis) to respectively form the two second side walls 32, and the two second side walls 32 are arranged opposite to each other. That is, an arrangement of the second top wall 31 and the two second side walls is roughly in the inverted U shape. One side edge of each of the two second side walls 32 that is opposite to another side edge of each of the two second side walls 32 connected to the second top wall 31 extends in the second direction (i.e., in the direction of the X-axis) to form the second fixing wall 33. That is, an arrangement of each of two second side walls 32 of each of the plurality of second casings 30 and second fixing wall 33 connected thereto is roughly in the L shape. The second direction is not parallel to the first direction, and the second direction can be perpendicular to the first direction, but is not limited thereto.

As shown in FIG. 3, the two second fixing walls 33 of each of the plurality of second casings 30 are fixedly disposed on the main body 10. Each of fixing walls 33 can be stackedly disposed on a top side of the main body 10, and a passage 37 is formed by the second top wall 31, the two second side walls 32 and the top side of the main body 10. The second top wall 31 of only one of the plurality of second casings 30 has the third through hole 35. Specifically, the second top wall 31 of one of the plurality of second casings 30 that is arranged under the two second through holes 27 has the third through hole 35. In the present embodiment, a position of the first through hole 103 of only one of the plurality of main bodies 10 corresponds to the third through hole 35 arranged on the second top wall 31. The recess 101 can be communicated with the passage 37 through the first through hole 103. The second fixing wall 33 can be fixed on the top side of the main body 10 by, for example, screwing, adhesive, soldering, etc., but is not limited thereto.

The supporting structure 80 in the first embodiment of the present disclosure can be adjusted according to practical requirements, and a number of the supporting structure 80 is not limited herein. As shown in FIG. 1, the number of the supporting structure 80 of the present embodiment is two.

The two joint fixing members 40 are respectively fixed in the two supporting structures 80, and each of the two joint fixing members 40 is correspondingly fixed in the plurality of the main bodies 10. The two joint fixing members 40 are respectively disposed on two sides of the main body 10 that are opposite to each other. Each of the two joint fixing members 40 has a plurality of third locking holes 41, and a number of the third locking holes is not limited herein. The number of the third locking holes 41 in the first embodiment of the present disclosure is six. A position of the third locking hole 41 can correspond to a position of the first locking hole 102 of the main body 10 and a position of a fifth locking hole 83 of the supporting structure 80, such that the plurality of main bodies 10, the two supporting structures 80, and the two joint fixing members 40 are correspondingly connected to each other through a cooperation of the plurality of third locking holes 41, the plurality of first locking holes 102, the plurality of fifth locking holes 83, and the plurality of lock members (e.g., the screws; not shown in the figures).

The plurality of second casings 30 are respectively fixed in the plurality of main bodies 10, and each of the two joint fixing members 40 and each of the two supporting structures 80 are not fixed in the plurality of second casings 30.

Each of the two supporting structures 80 is roughly in an S shape. The supporting structure 80 has a pivot structure 81, a plurality of fourth locking holes 82, and the plurality of fifth locking holes 83. Each of a number of the fourth locking holes 82 and each of a number of the fifth locking holes 83 can be adjusted according to the practical requirements, but are not limited herein. The fourth locking hole 82 is arranged at one end of the supporting structure 80, and the fifth locking hole 83 is arranged at another end of the supporting structure 80. The two supporting structures 80 are used for supporting the first casing 20 and are disposed on the main body assembly, so that the first casing 20 is external to the second casing 30, and the bottom plate 26 of the first casing 20 and the second top wall 31 of the second casing 30 having the distance therebetween. The distance between the bottom plate 26 of the first casing 20 and the second top wall 31 of the second casing 30 can be adjusted according to the practical requirements, but is not limited herein. The distance in the first embodiment of the present disclosure is at least 4 cm, and preferably between 6 cm and 10 cm. The distance can be 6 cm, 7 cm, 8 cm, 9 cm or 10 cm. The supporting structure 80 can effectively prevent the heat generated by the light-emitting module 60 from damaging the control module 50 by heat transferring.

As shown in FIG. 3, the plurality of main bodies 10 are aligned with each other, and the plurality of second casings 30 are aligned with each other. In addition, each of the plurality of second casings 30 has the passage 37, and multiple ones of the passages 37 are communicated with each other so as to form a through-passage 38. The through-passage 38 can be used for increasing a heat dissipation surface area of the lighting device L.

The control module 50 is fixedly disposed in the first casing 20. In another application, the control module 50 can include at least one electrical connector (not shown in the figures). Alternatively, each of the plurality of light-emitting modules 60 can be electrically connected to the control module 50 in a manner of soldering through the electrical connection line 61 that passes through the first through hole 103 of a corresponding one of the main body 10. In this way, the light-emitting module 60 can be easily mounted and replaced by a relevant personnel. The control module 50 is electrically connected to the light-emitting module 60 through the electrical connection line 61, so that the control module 50 can control operation of each of the plurality of light-emitting modules 60, such as turning on or off the light-emitting module 60, controlling brightness of a light beam emitted by each of the plurality of light-emitting modules 60, controlling color temperature of the light beam emitted by each of the plurality of light-emitting modules 60, etc. The control module 50 can be electrically connected to an external power supply, such as utility power, and can convert the utility power to a predetermined voltage and current to be provided to each of the plurality of light-emitting modules 60. In another application, the control module 50 can also include a wireless communication unit, and the control module 50 can be electrically connected to an external electronic device through the wireless communication unit. In this way, the relevant personnel can control each of the plurality of light-emitting modules 60 through the external electronic device that is connected to the control module 50. The external electronic device is, for example, a smartphone, an industrial hand-held electronic device, etc.

The three light-emitting modules 60 are disposed in the recess 101 of one of the three main bodies 10, but a number of the light-emitting modules 60 disposed in each of the three main bodies 10 is not limited thereto, and can be adjusted according to the practical requirements. That is, each of the three main bodies 10 can have more than three light-emitting modules 60 disposed therein, or, each of the three main bodies 10 can have one or two light-emitting modules 60. In one example of the first embodiment of the present disclosure, in which the recess 101 of the main body 10 is configured to have two light-emitting modules 60 disposed therein, when the recess 101 of the main body 10 has a single light-emitting module 60 disposed therein, an area of the main body 10 where the light-emitting module 60 is disposed can have an auxiliary heat dissipation element (e.g., a heat dissipation fin) disposed therein, so as to assist in dissipating the heat generated by the light-emitting module 60 during operation to the outside.

As shown in FIG. 5, each of the plurality of light-emitting modules 60 includes the electrical connection line 61 as shown in FIG. 3, a circuit board 62, a plurality of light-emitting units 63, and a light transmitting assembly 64. The circuit board 62 is fixedly disposed in the main body 10, and can be stackedly disposed on a bottom of the recess 101. The plurality of light-emitting units 63 are fixedly disposed on a side of the circuit board 62 that is away from the bottom of the recess 101. The light transmitting assembly 64 is fixedly disposed on the side of the circuit board 62 that is away from the bottom of recess 101, and the light transmitting assembly 64 correspondingly covers the plurality of light-emitting units 63. Each of the plurality of light-emitting units 63 is, for example, a variety of light-emitting diodes, and can be selected according to requirements.

The two first covers 71 are fixedly disposed on two sides of the first casing 20, respectively. The first cover 71 is fixedly disposed on a corresponding side of the first casing 20 through a cooperation of the first cover 71 and the plurality of lock members (e.g., the screws). As shown in FIG. 3, after the two first covers 71 and the first casing 20 are affixed to each other, the two first covers 71, the bottom plate 26 and the first casing 20, jointly define a first closed space 282. The control module 50 is accommodated in the first closed space 282.

As shown in FIG. 6, at least one auxiliary fixing structure 24 can be formed on a side of the first casing 20 that faces the main body 10. Specifically, the first casing 20 can have four first auxiliary fixing structures 24, of which two of the four first auxiliary fixing structures 24 can be respectively formed in two parts of the first casing 20 where the first top wall 21 is correspondingly connected to the two first side walls 22, and another two of the four first auxiliary fixing structures 24 can be formed in another two parts of the first casing 20 where the two first side walls 22 are respectively connected to the two first fixing walls 23, but is not limited thereto. Each of the four first auxiliary fixing structures 24 can have a first caulking groove 241. In addition, each of the two first covers 71 can be fixedly disposed on the corresponding side of the first casing 20 through a cooperation of the lock members (e.g., the screws) and the first auxiliary fixing structure 24.

The two second covers 72 are respectively disposed on two ends of the through-passage 38. Each of the two second covers is fixedly disposed on a corresponding one of the plurality of second casings 30 through a cooperation of the second cover 72 and the plurality of lock members (e.g., the screws). After the two second covers 72 are respectively fixed in the two corresponding second casings 30, the two second covers 72 respectively cover the two ends of the through-passage 38, so as to close the through-passage 38. That is, as shown in FIG. 3, a second closed space 39 is formed by the two second covers 72, the top sides of the plurality of main bodies 10, and the plurality of second casings 30. In practical applications, a waterproof element can be disposed at a periphery of where the second cover 72 and the second casing 30 are connected, such as a waterproof strip and a waterproof gasket, so that external moisture and dirt can be prevented from easily entering the second closed space 39.

As shown in FIG. 7, each of the plurality of second casings 30 can have at least one second auxiliary fixing structure 34 formed on a side facing the main body 10. Specifically, each of the plurality of second casings 30 can have four second auxiliary fixing structures 34, of which two of the four second auxiliary fixing structures 34 can be respectively formed in two parts of the second casing 30 where the second top wall 31 is corresponding connected to the two second side walls 32, and another two of the four second auxiliary fixing structures 34 can be formed in another two parts of the second casing 20 where the two second side walls 32 are respectively connected to the two second fixing walls 33, but is not limited thereto. Each of the four second auxiliary fixing structures 34 can have a second caulking groove 341. In addition, each of the two second covers 72 can be fixedly disposed on the corresponding side of the corresponding second casing 30 through a cooperation of the lock members (e.g., the screws) and the second auxiliary fixing structure 34.

Second Embodiment

Figure 8:
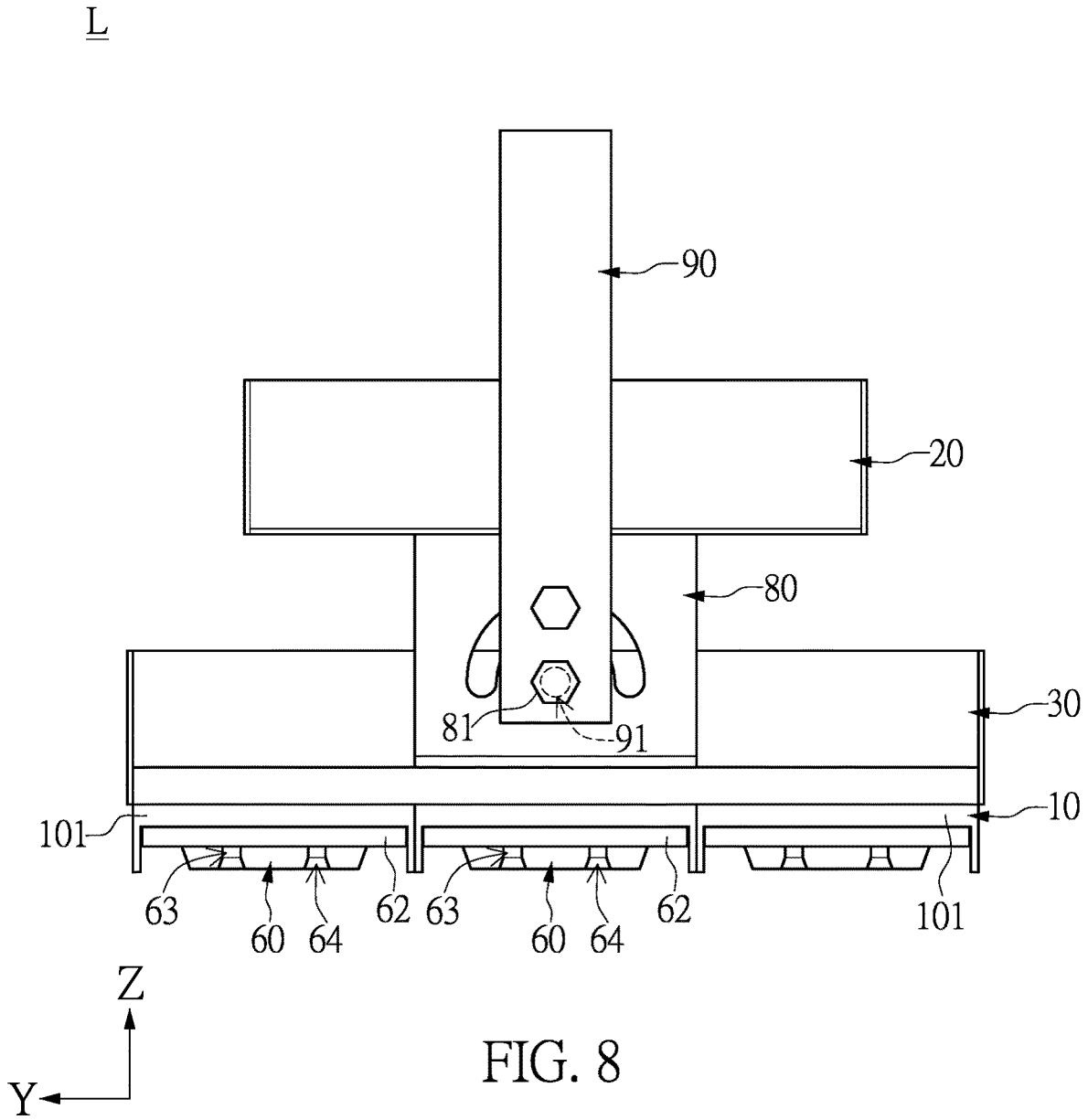
FIG. 8 is a schematic side view of a lighting device according to a second embodiment of the present disclosure.

Referring to FIG. 8, the present embodiment is similar to the first embodiment, and the similarities therebetween (e.g., the main body 10, the first casing 20, the second casing 30, the joint fixing member 40, etc.) will not be reiterated herein.

Referring to FIG. 8, FIG. 8 is a schematic view of a lighting device according to a second embodiment of the present disclosure. The main difference between the present embodiment and the preceding embodiment is that, the lighting device L can also include a handle structure 90 that has two ends fixedly disposed on the two supporting structures 80, respectively. The handle structure 90 has a plurality of through holes 91, and the handle structure 90 can be correspondingly engaged to the two pivot structures 81 of the two supporting structures 80 through the plurality of through holes 91, so that the handle structure 90 can be rotated relative to the corresponding main body 10 that the handle structure 90 is connected to. Through a design of the handle structure 90, an overall inclination angle of the lighting device L can be adjusted on demand by the relevant personnel.

Third Embodiment

Figure 9:
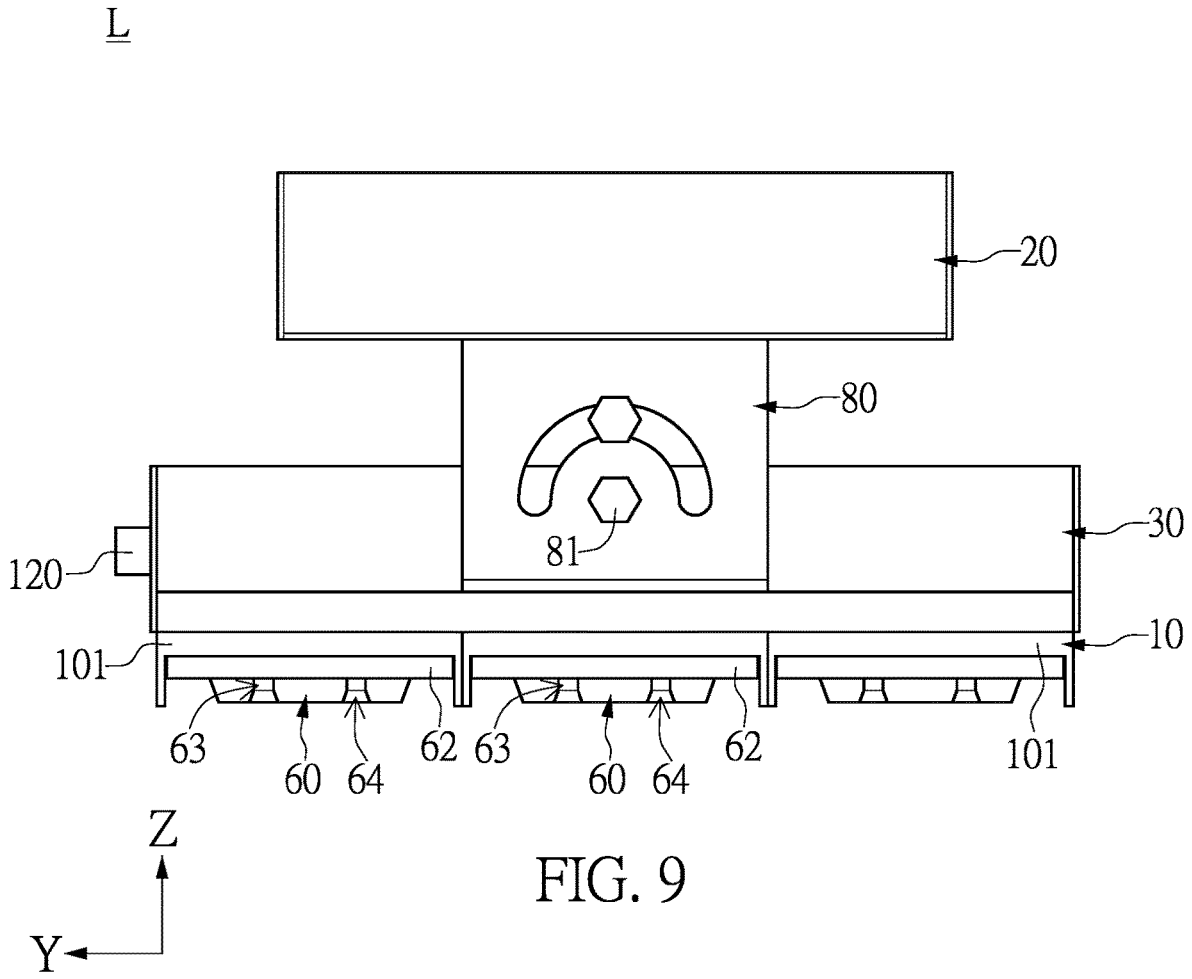
FIG. 9 is a schematic side view of a lighting device according to a third embodiment of the present disclosure.

Referring to FIG. 9, the present embodiment is similar to the first embodiment, and the similarities therebetween (e.g., the main body 10, the first casing 20, the second casing 30, the joint fixing member 40, etc.) will not be reiterated herein.

Referring to FIG. 9, FIG. 9 is a schematic view of a lighting device according to a third embodiment of the present disclosure. The main difference between the present embodiment and the preceding embodiments is that, the lighting device L can also include a sensor 120. The sensor 120 is fixedly disposed on at least one of the plurality of second casings 30, and is electrically connected to the control module 50 (not shown in the figures). The sensor 120 is configured to transmit a sensing signal to the control module 50 in response to sensing a predetermined organism (e.g., a human being). For example, the sensor 120 can be an infrared sensor, an ultrasonic sensor, or an image capture device, but is not limited thereto. An arrangement of the sensor 120 can be chosen according to requirements, and the sensor 120 can be disposed, for example, on the main body 10 or the joint fixing member 40.

Beneficial Effects of the Embodiments

In conclusion, one of the beneficial effects of the present disclosure is that, in the lighting device provided by the present disclosure, the control module accommodated in the first casing is separated from the lighting-emitting modules arranged on the bottom sides of the main bodies by the supporting structure, so that the heat generated by the light-emitting modules with high wattage can avoid affecting a life and performance of the control module by the heat transferring and the thermal convection. Therefore, the service life and performance of the lighting device with high wattage can be effectively increased in specific environments.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A lighting device, comprising:

a plurality of main bodies each being strip-shaped, wherein the plurality of main bodies are aligned with each other and collectively defined as a main body assembly;

a first casing having a first top wall, two first side walls, and two first fixing walls, wherein two side edges of the first top wall that are opposite to each other are respectively connected to the two first side walls, the two first side walls are arranged opposite to each other, one side edge of each of the two first side walls that is opposite to another side edge of each of the two first side walls connected to the first top wall extends in a direction away from the side wall and is connected to one of the two first fixing walls, and the first casing defines a first accommodation space;

two first covers fixedly disposed on two sides of the first casing, respectively;

at least one supporting structure disposed on the main body assembly so as to support the first casing, wherein the at least one supporting structure has a pivot structure;

two joint fixing members, wherein each of the two joint fixing members is configured to fix the main body assembly and the supporting structure in position;

a control module fixedly disposed in the first casing, wherein the control module is disposed in the first accommodation space;

a plurality of light-emitting modules, wherein at least one of the plurality of light-emitting modules is fixedly disposed on a bottom side of each of the plurality of main bodies, and each of the plurality of light-emitting modules includes a circuit board, a plurality of light-emitting units, and a light transmitting assembly, and wherein the circuit board is fixedly disposed on the bottom side of the main body, the plurality of light-emitting units are disposed on a side of the circuit board that is away from the bottom side of the main body, the light transmitting assembly is fixedly disposed on the side of the circuit board that is away from the bottom side of the main body, and the light transmitting assembly correspondingly covers the plurality of light-emitting units; and a plurality of second casings each being strip-shaped;

wherein each of the plurality of second casings has a second top wall, two second side walls, and two second fixing walls;

wherein a passage is jointly defined by the second top wall, the two side walls, and a top side of the main body;

wherein two side edges of the second top wall that are opposite to each other correspondingly extend in a first direction to form the two second side walls, the two second side walls are arranged opposite to each other, one side edge of each of the two second side walls that is opposite to another side edge of each of the two second side walls connected to the second top wall extends in a second direction and is connected to one of the two second fixing walls, the second direction is not parallel to the first direction, and the second casing defines a second accommodation space;

wherein the plurality of second casings are aligned with each other and collectively defined as a casing assembly, and multiple ones of the passages respectively of the plurality of second casings of the casing assembly are communicated with each other so as to form a through-passage;

wherein each of the plurality of light-emitting modules includes at least one electrical connection line, the at least one electrical connection line is electrically connected to the control module, and the control module is configured to control each of the plurality of light-emitting modules.

2. The lighting device according to claim 1, wherein the first casing includes a bottom plate, the bottom plate is correspondingly connected to the two first side walls; wherein the bottom plate, the two first covers, and the first casing jointly define a first closed space, the first closed space is configured to accommodate the control module, and the bottom plate has two through holes.

3. The lighting device according to claim 1, further comprising:

a handle structure having a plurality of through holes;

wherein the plurality of through holes are correspondingly engaged to the at least one pivot structure, so that the handle structure is capable of being rotated, through the pivot structure, relative to the main body that the handle structure is connected to.

4. The lighting device according to claim 1, wherein one side of each of the plurality of main bodies is recessed to form a recess, the bottom side of the main body is located at a bottom of the recess, and each of the plurality of light-emitting modules is arranged in a corresponding one of the recess.

5. The lighting device according to claim 1, wherein four auxiliary fixing structures are formed on a side of the first casing that faces the main body; wherein two of the four auxiliary fixing structures are respectively formed in two parts of the first casing where the first top wall is correspondingly connected to the two first side walls, and another two of the four auxiliary fixing structures are formed in another two parts of the first casing where the two first side walls are respectively connected to the two first fixing walls; wherein each of the two first covers is affixed to the corresponding side of the first casing through a cooperation of a lock member and the four auxiliary fixing structures.

6. The lighting device according to claim 1, wherein each of the plurality of second casings includes two second covers, the two second covers are respectively and fixedly disposed on two ends of the through-passage, the two second covers respectively cover two openings at the two ends of the through-passage, and the two second covers, the top sides of the plurality of main bodies, and the plurality of second casings jointly define a second closed space.

7. The lighting device according to claim 1, further comprising:

a sensor fixedly disposed on at least one of the plurality of second casings;

wherein the sensor is electrically connected to the control module, and the sensor is configured to transmit a sensing signal to the control module in response to sensing a predetermined organism.

8. The lighting device according to claim 1, wherein the first casing includes a bottom plate, the bottom plate is correspondingly connected to the two first side walls, and the bottom plate, the two first covers, and the first casing jointly define a first closed space; wherein the first closed space is configured to accommodate the control module, and a distance between the bottom plate of the first casing and a top side of the second casing is at least 4 cm.

* * * * *